US009127451B1

(12) United States Patent
Boor

(10) Patent No.: US 9,127,451 B1
(45) Date of Patent: Sep. 8, 2015

(54) CONCEALED-FASTENER EXTERIOR CLADDING PANELS FOR BUILDING CONSTRUCTION

(71) Applicant: Lester Building Systems, LLC, Lester Prairie, MN (US)

(72) Inventor: Paul A. Boor, Hutchinson, MN (US)

(73) Assignee: Lester Building Systems, LLC, Lester Prairie, MN (US)

( * ) Notice: Subject to any disclaimer, the term of this patent is extended or adjusted under 35 U.S.C. 154(b) by 0 days.

(21) Appl. No.: 14/176,586

(22) Filed: Feb. 10, 2014

(51) Int. Cl.

| | |
|---|---|
| ***E04D 3/30*** | (2006.01) |
| ***E04B 1/70*** | (2006.01) |
| ***E04B 1/38*** | (2006.01) |
| ***E04B 1/68*** | (2006.01) |
| ***E04F 13/22*** | (2006.01) |

(52) U.S. Cl.
CPC ..... *E04B 1/7038* (2013.01); *E04B 1/38* (2013.01); *E04B 1/6803* (2013.01); *E04F 13/22* (2013.01)

(58) Field of Classification Search
CPC ..... E04B 1/6803; E04F 13/22; E04D 1/34; E04D 3/00; E04D 3/16; E04D 3/24; E04D 3/30; E04D 3/3605; E04D 3/365
USPC ..... 52/519–521, 470, 471, 537, 538, 545, 52/549, 478, 522, 544, 543, 748.11
See application file for complete search history.

(56) References Cited

U.S. PATENT DOCUMENTS

| | | | |
|---|---|---|---|
| 511,386 | A | 12/1893 | White |
| 2,150,130 | A | 3/1939 | Ragsdale et al. |
| 2,356,833 | A | 8/1944 | Doe |
| 2,358,733 | A | 9/1944 | Overly |
| 3,509,675 | A | 5/1970 | McClain |
| 3,606,720 | A | 9/1971 | Cookson |
| 4,193,242 | A | 3/1980 | Vallee |
| 4,266,385 | A | 5/1981 | Oehlert |
| 4,400,924 | A | 8/1983 | Andrews |
| 4,590,730 | A | 5/1986 | Blendick |
| 4,759,165 | A | 7/1988 | Getoor et al. |
| 4,959,939 | A | 10/1990 | Buchanan, Jr. |
| 5,152,115 | A | 10/1992 | Cotter |
| 5,187,911 | A | 2/1993 | Cotter |
| 7,104,020 | B1 | 9/2006 | Suttle |

*Primary Examiner* — William Gilbert
(74) *Attorney, Agent, or Firm* — Moss & Barnett

(57) ABSTRACT

An exterior cladding panel assembly for covering an outside surface of a framed building is provided by the invention. A unique rib and batten system with overlapping raised female and male edge ribs on the adjacent installed panels, and raised interior ribs allow through fastening of the panels on the order of 32 inches or wider to the building's underlying framing structure with complete concealment of the fasteners, and without the need for special fastener clips. The ribs have an inverted U-shaped end profile that creates an open cavity between the rib top wall and the underlying framing member. The fastener can be driven through the rib top walls into the framing member without the need for a solid filler cleating strip.

19 Claims, 6 Drawing Sheets

CONCEALED-FASTENER EXTERIOR CLADDING PANELS FOR BUILDING CONSTRUCTION

FIELD OF THE INVENTION

This application relates generally to exterior cladding panels for covering the roof or wall of a building, and more specifically to such a panel with the associated screw being fastened through the underlying building frame.

BACKGROUND OF THE INVENTION

All shelter buildings, whether they are houses or agricultural or commercial structures, must be strong, stable, and weather-resistant. Such structures are typically framed from an assembly of interconnected wood or metal members that define their walls and roof line. Vertical studs and horizontal base plates and header plates provide structure to the walls, while defining door and window openings. A series of rafters and purlins provide structure to the roof while defining its ridges and valleys. This roof can ultimately be covered by an appropriately decorative and weather-tight material like asphalt, wood or slate shingles, or clay tiles. Likewise, the walls can be covered by a suitably decorative or weather-resistant material like wood, brick, or plastic siding, stone, or stucco.

Interposed usually between this exterior roofing or wall covering material and the framing assembly are rigid panels made from plywood or other composite materials. These rigid panels are nailed, screwed, or otherwise fastened to the rafters and purlins or studs. They not only provide a necessary backing support to the exterior roofing or wall cladding material, but also they provide essential strength to the underlying framing assembly and its individual rafter and purlin and stud members.

An alternative type of exterior cladding material for a roof or wall is a panel made from a metallic material like galvanized steel. Steel panels can be more durable over time than wood siding or asphalt or wood shingles. If properly surface-treated, metal panels are resistant to the weather elements, and are usually cheaper than brick or stone, particularly when installation costs are taken into account. Moreover, the strength provided by these rigid metal panels allow for the elimination of the need for the plywood or composite structural sheathing underlying the panels.

Corrugated wrought iron-steel panels coated with zinc (e.g., "galvanized") have been used for a long time in the construction industry. These corrugated metal panels are nailed directly through the panel into the underlying wood roof rafter and purlin or wall stud supporting structure. However, the fastener heads directly show on top of the metal panels, which can interfere with the decorative appearance of the metal panels, especially if the fastener heads were not fastened with uniform spacing along the metal panels. Moreover, these exposed fastener heads must include a rubber or elastomeric washer interposed between the fastener head and the metal sheet that seals the area around the fastener to reduce the penetration of moisture from rain or snow through the protective metal panel via the hole formed by the fastener.

Through-fastened metal panels can be fastened anywhere across the width of the panels. This allows wide panels on the order to 36 inches or greater to be securely fastened to the building's framing structure. These panels typically have a large corrugation called a "major rib" at each panel edge and intermittently across the width of the panel. These ribs give the panel strength to span, e.g., open purlins along the building's roof line. The major ribs are formed along the edges of the panels, so that one laps the other during installation to form a continuous covering for the roof. Fasteners are usually installed through this common rib to securely connect the panel assembly to the underlying framing structure. Such through-fastened panel assembly braces the framing members to form structural diaphragms and shear walls that brace the entire structure. Hence, through-fastened panels not only provide weather protection to the building, but also form a major part of the building's lateral load resisting system.

U.S. Pat. No. 4,193,242, issued to Vallee provides an example of such through-fastened metal panels. In this case, the panel portions are abutted in a side-by-side relationship, and are screwed directly into the rafters. A cover cap is slid into engagement with standing flanges rising vertically from the panel edges to conceal the screw heads. Thus, the Vallee panel constitutes a through-fastened, fastener-concealed panel.

U.S. Pat. No. 3,509,675, issued to McClain and U.S. Pat. No. 4,959,939, issued to Buchanan, Jr. provide examples of through-fastened metal panels that are overlapped one edge on top of the other panel's edge, and screwed directly into the rafters. In both of these cases, a snap-on batten cap is used to conceal the screw heads.

U.S. Pat. No. 4,266,385, issued to Oehlert constitutes a through-fastened roofing panel design featuring a partial raised rib along its one edge and upturned rib wall along its other edge. When two such metal panels are placed on top of the rafters next to each other, nails can be driven through one panel into the underlying rafter along the raised rib wall, with the partial raised rib of the other panel hooked around the raised rib wall to complete the raised rib and conceal the nail heads. See. While this particular design eliminates the need for special propositioned clips, it does require a more elaborately shaped end profile for the metal panels. Such elaborate shapes can be expensive to produce and make it difficult to stack the metal panels during transport or storage. See also U.S. Pat. No. 4,759,165, issued to Getoor et al. U.S. Pat. No. 3,606,720 issued to Cookson discloses two adjacent through-fastened metal panels whose edges are hooked into each other with a batten cap further hooking into flanged surfaces on the panels to conceal the fastener heads.

Standing-seam metal panels are not attached directly to the roof's framing members. The simplest standing-seam panel system consists of a flat pan with the edges bend up at ninety degree angles. A light-gauge metal clip hooks over the panel edges, and is screwed into the supporting structure. The next panel is then installed, partially hiding the attachment clip. A batten is snapped over the seam to complete the rib. Because the clips indirectly attach the panels to the framing members, such standing-seam panels "float" along the roof. See, e.g., U.S. Pat. No. 2,356,833 issued to Doe.

U.S. Pat. No. 2,150,130, issued to Ragsdale et al., shows removable wall panels consisting of multiple raised metal panels having horizontally disposed edges. The edge of one panel is placed on top of the edge of the next panel, and a spring clip is then secured on top of the panel edges and bolted into the underlying structural wall member to hold the metal panels in place. A cap having a similar shape to the spring clip's shape is then snap-fitted over the clip to conceal the bolt heads.

In other cases, a series of clips are positioned underneath the standing-seam panels, and therefore must be secured in precise locations along the rafters. See U.S. Pat. No. 4,590,730, issued to Blendick in which two secondary clips secure the metal panels edges to the primary clip that was secured to the rafter. A batten fits over the clips to conceal the nail head.

See also U.S. Pat. No. 4,400,924, issued to Andrews where a panel is positioned on top of the rafters, clips are installed in place to capture the leading edge of the panel, then the next panel is placed by rotating its specially diagonally upturned edges snap-fitted into engagement with the flanges of the clips. Finally, a batten cover is snap-fitted over the clips and into engagement with the upturned edges of the metal panels to conceal the nail heads. U.S. Pat. Nos. 5,152,115 and 5,187,911 issued to Cotter disclose a standing-seam roofing/cladding system that relies upon both clips and interlocking edges of adjacent metal panels to secure them by means of screws to the underlying rafters or studs. A separate batten cap is still required to conceal the screw heads.

However, such standing-seam panels require the usage of a plurality of special clips above and beyond the metal panels, themselves. Moreover, many of them require these clips to be precisely positioned along the rafters before the metal panels are laid down on the rafters, which slows down the roof assembly process. Furthermore, the clips used to attach the standing-seam panels occur only at the panel edges. This limits the width of the panels to roughly 18 inches for vertical-leg panels, and 24 inches for trapezoidally-seamed panels. Still another disadvantage of standing-seam panels is the fact that they cannot brace the framing structure of the building in the way that through-fastened panels do. Furthermore, standing-seam panels cannot form a structural diaphragm, and therefore are not part of the building's lateral load system.

U.S. Pat. No. 7,104,020 issued to Suttle discloses a standing beam structural panel. Each panel has multiple ribs formed into it. The edges of adjacent panels are overlapped, and screwed directly against the rafters. A sealing cap is then secured around the top of the edge ribs and intermediate ribs to conceal the screw heads, and provide a uniform appearance to the panel assembly.

Still other metal panel products known in the art provide raised ribs for decorative purposes. The edges of the adjacent panels are positioned either side-by-side or in an overlapped relationship to form a raised rib volume with a separate piece of wood cleating used to fill this volume, and provide a raised surface onto which the panel edges can be nailed. See, e.g., U.S. Pat. No. 511,386 issued to White, and U.S. Pat. No. 2,358,733 issued to Overly. However, these wood cleats must be fastened to the roof rafters with correct spacing before the roof panels can be positioned on top of the rafters and nailed to the cleats. This can be a time-consuming process.

Therefore, providing a weather-resistant exterior cladding panel for building construction having raised ribs for structural and decorative purposes that can be secured to roof rafters or side wall studs without clips or raised solid wood cleating backing strips, and which conceal screw or nail heads from moisture penetration would be advantageous. The lateral edges of the panel assembly along a roof or wall end should be secured to combat the effects of wind shear. Moreover, the shanks of the nails or screws used to secure the panel assembly should be resistant to wind shear. Finally, the individual panels should have a profile that allows them to be stacked during transport or storage or at a construction site.

SUMMARY OF THE INVENTION

An exterior cladding panel assembly for covering an outside surface of a framed building is provided by the invention. A unique rib and batten system allows through fastening of wide panels on the order of 32 inches or greater to the building's underlying framing structure with complete concealment of the fasteners. The panels are substantially planar with a female raised major rib along their first lateral edge, a supporting male end rib along the opposite lateral edge, and full raised major ribs along interior positions therebetween. These female and male edge ribs are formed along the panels such that when the female rib of one panel laps over the male rib of the other panel to form an interconnected panel assembly, proper panel alignment is produced. The lapped ribs of the panels are then attached to the underlying framing of the building structure by means of a common nail or screw driven through the raised ribs with a space between the rib top surface and the underlying framing member, thereby resulting in a shear connection with the associated bracing properties, thereby enhancing the building's structural integrity.

The ribs are formed with an inverted U-shaped end profile, instead of a W-shaped end profile found in the prior art, to eliminate two vertical legs and reduce materials and manufacturing costs for the panels and make it easier for a construction worker to attach them to the building. The ribs are formed with longitudinal detents in each face. A batten cap is snapped into engagement with these longitudinal detents along the major rib to cover the nail or screw heads to render the panels moisture and weather-resistant.

The overlapping female and male ribs of the through-fastened, fastener-concealed panels of the present invention produce "stitched edges" in combination with the common fastener driven through the lapped ribs to prevent movement between the panels. These stitched panels transfer shear forces via tension fields from one panel to the next panel. It is this force transfer that enables the stitched panels to function as the shear transfer element of the diaphragm system, thus eliminating the need for sub-sheathing to perform that function. The through-fastened, fastener-concealed panels of the present invention also eliminate the need for clips used in the prior art systems to attach the panels to the underlying framing members. This saves material and labor costs, while enabling more direct, stronger, and rigid connection between the panel and the structural framing. Also, the panels of the present invention are designed, so that they can be installed to the roof without the need for solid backing material. This feature saves the materials and labor needed to install the filler. The flat region of the panels between the major ribs preferably includes at least one inverted minor rib having a substantially flat bottom surface. The bottoms of the minor ribs are slightly lower than the exposed flat panels. Thus, the panel flats do not make firm contact with the purlins. This minor rib acts to break up the flat region to stiffen its material to decrease the natural tendency of the panel to move towards and away from the building's underlying framing members to produce undulations in the panel's flat regions ("oil canning"). These minor ribs also space the panel a slight distance from the framing member to reduce the natural tendency of the panel to telegraph ("show") the form of the underlying framing member in its material ("ghosting").

The ribs taper from wide at the bottom to narrow at the top. This taper allows the panels to nest. Nesting panels simplifies shipping, thereby reducing transport costs. Moreover, the panels may be stacked on top of each other during storage or at a construction site.

In a preferred embodiment, special nails or screws having an extended shank with a substantial solid portion of the shank without threads are used to secure the panel assembly to the framing member. By driving the extended shank portion of the screw or nail below the framing member surface, wind-induced uplift of the panel assembly is reduced while also reducing wind-induced shearing of the screws or nails along the outer surface of the framing member.

In a preferred embodiment, a flat region of the panel assembly is secured directly to the framing members along the edge of the roof line or wall to thwart the panel from moving under the influence of the wind along the framing members of the roof or wall.

The through-fastened, fastener-concealed panels of the present invention are used to form water-shedding roof and wall systems. They can be used anywhere through-fastened panels have been traditionally used. The panels can also be used to replace water-shedding, standing-seam panels. Furthermore, the panels can replace other types of water-shedding finishes, including asphalt shingles, wood shakes, clay tiles, lap siding, etc.

The through-fastened, fastener-concealed panels of the present invention are designed to span open purlins, No structural sheathing is required. Assemblies that include the panels have excellent shear strength and stiffness. These assemblies therefore can be used as part of the building's lateral load-resisting system.

DETAILED DESCRIPTION OF THE PREFERRED EMBODIMENT

Figure 1:
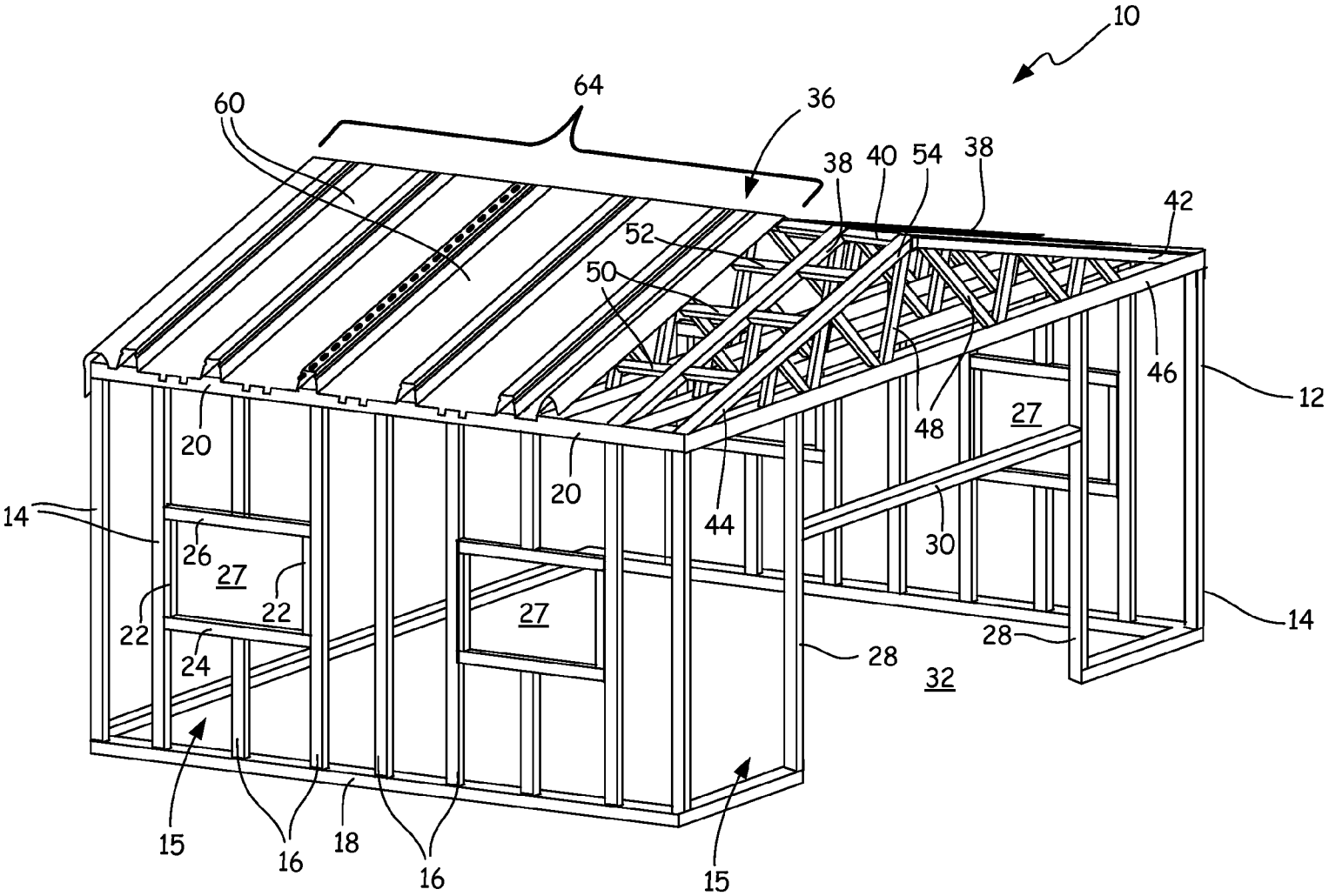
FIG. 1 is a perspective view of a building under construction with part of the roof covered by the exterior cladding panel assembly of the present invention.

The roof industry has for decades searched for a panel that has the weathering and appearance characteristics of current standing-seam panels, and the bracing and diaphragm capacity inherent with through-fastened, concealed fastener panels. An exterior cladding panel assembly for covering an outside surface of a framed building is provided by the invention. A unique rib and batten system with overlapping raised female and male edge ribs on the adjacent installed panels, and raised interior ribs allow through fastening of the panels on the order of 32 inches or wider to the building's underlying framing structure with complete concealment of the fasteners, and without the need for special fastener clips. The ribs have an inverted U-shaped end profile that creates an open cavity between the rib top wall and the underlying framing member. The fastener can be driven through the rib top walls into the framing member without the need for a solid filler cleating strip. The lapping female and male ribs also force proper alignment of the panels with each other during installation. Special inverted ribs extending downwardly from the panel offsetting the flat panel surfaces from the framing members to minimize the formation of undulations in the panel's flat region ("oil canning") and the formation of the framing member's shape over time in the panel ("ghosting"). Tapered side walls on the raised and inverted ribs allow the panels to nest one on top of another during transport, storage, or at the construction site.

In the context of the present application, "exterior cladding panel" means a substantially planar piece of structural component that is positively connected to the framing structure of a building to strengthen the framing structure and achieve shear value, while providing weather-resistant protection to the building interior. Such exterior cladding panel include raised ribs interposed along the otherwise planar profile. The ribs provide structural integrity and a pleasing aesthetic. The panels may be used to cover a portion of the building such as a roof or wall.

For purposes of the present invention, "building" means any usually roofed and walled structure built for permanent use, including, without limitation, a house; apartment; pole barn; farm or ranch building like a machine shed or shop, cold storage, heated farm shop, agricultural building, or grain storage; livestock building like livestock housing, dairy building or milking parlor, hog nursery, hay or grain storage, or offices; equestrian building like a horse barn, stalls, stables, riding arena, or tack room; hobby building like a garage, storage shed, or work shop; or commercial building like an office, retail store, restaurant, event center, municipal building, self-storage building, mini-storage building, church, or warehouse.

As used within this Application, "framing member" means any wood or metal member that is interconnected to other members to provide the framing structure underneath the exterior cladding for a building, such as rafters, purlins, studs, header plates, or footer plates.

While the exterior cladding panel assembly of the present invention is disclosed for purposes of this Application as a roof for a building, it should be understood that the exterior cladding panel assembly may be used to cover a different portion of a building frame, such as a wall. It should also be understood that the panels may be used to cover an interior ceiling or wall of the building where weather resistance is not necessarily required. Such interior application of the panels will help to brace and strengthen the building's framing structure, while providing an aesthetically pleasing design element.

The exterior cladding panel assembly 10 of the present invention is shown in FIG. 1 in partially cut-away view. A building 12 has a structure defined by a plurality of framing members 14 connected to each other. More specifically, the four walls 15 of the building (two shown) are defined by a plurality of vertical studs 16 that are connected at their bottom ends to footer plate 18, and at their top ends to header plate 20. Extra studs 22 along with footer plate 24 and header plate 26 define window openings 27. Similarly, extra studs 28 and header plate 30 define door opening 32.

Meanwhile, the roof 36 of the building 12 is defined by a series of rafters 38 and a ridge purlin 40. The rafters 38 may entail individual boards, or else the top members of preassembled trusses 42 that comprise interconnected rafter boards 44, bottom plate 46, and a plurality of angled support members 48 for strengthening the truss and displacing the load carried by the roof. The rafters or top rafter elements of the trusses 42 are sloped to define the pitch of the roofline. Finally, a series of purlin members 50 are attached between the rafters or rafter elements of the trusses to provide lateral stability and maintain the vertical alignment of the rafters or trusses. These purlins 50 also provide attachment surfaces 52 along their top surfaces along with the attachment surfaces of the rafters or trusses for securement of the exterior cladding panels 60, as described below.

The exterior cladding panels 60 are secured to the roof of building 12 by means of fasteners 62 with adjacent panels attached to each other to form exterior cladding panel assembly 64. The panel 60, as shown more clearly in FIG. 2, has a nominal width W of 32 inches, which is measured from the centers of female end rib 66 and supporting male end rib 68. Typically, the panel can be manufactured to a length L of 40 feet or longer. These dimensions are typical for the exterior cladding panel 60 of the present invention, and not meant to limit it in any manner.

The panel 60 comprises female end rib 66 along its one edge 70. This female end rib 66 is formed from tapered side wall 72 extending upwardly from horizontal panel wall 102, top wall 74 with longitudinal crease 75 formed therein, and side wall 76 which extends partially downwardly towards the panel wall 102 and substantially planar surface 78 of panel 60 without touching it. Formed along side walls 72 and 76 near top wall 74 are the detent grooves 80 which run the length of the panel.

Supporting male end rib 68 is formed along edge 82 of panel 60, which is the opposite edge of edge 70. This supporting male end rib 68 is formed with first tapered side walls 84, second tapered side walls 86 having a slope greater than the slope of first tapered side walls 84, and top wall 88. Supporting male end rib 68 does not include any detent grooves.

Panel 60 also includes at least one interior upright rib 90 formed along panel 60 between female end rib 66 and supporting male end rib 68. If there is only one interior upright rib 90 ion panel 60, it will be formed along the center of the panel. If there are multiple interior upright ribs 90, they will be formed along the panel so that the spacing distance D between female end rib 66 and interior upright rib 90, between two interior upright ribs 90, and between interior upright rib 90 and supporting male end rib 68 are substantially equal. Interior upright rib 90 is formed from two complete tapered side walls 92 and top wall 94, and features a pair of detent grooves 96 near the top wall. The end profile for interior upright rib 90 and female end rib 66 should be substantially similar in terms of the width of top walls 94 and 66, lengths and slopes of side walls 92 and 72, and the positioning of longitudinal detent grooves 96 and 80 so that the two ribs will look substantially similar for aesthetic purposes for the panel.

Also extending along panel 60 are a plurality of inverted "minor" ribs 100. These ribs 100 have substantially flat bottom walls 102 flanked by tapered side walls 104. The width $X_1$ of flat bottoms walls 102 should be substantially less than the width $X_2$ of the panel regions 78 between adjacent inverted ribs 100.

Figure 3:
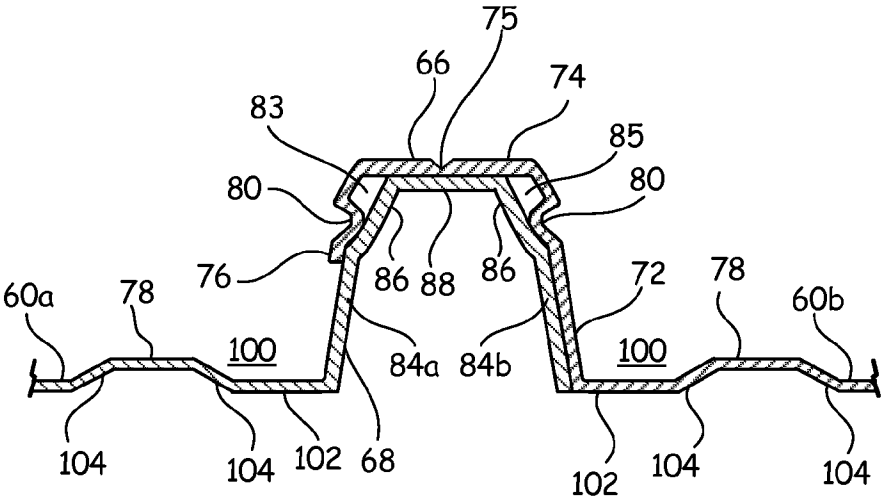
FIG. 3 is an enlarged end view of an overlapping joint between the edges of two adjacent panels without the batten cap cover of FIG. 4.

Referring now to FIG. 3, an enlarged end view of the overlapping joint between the edges of a pair of adjacent panels 60*a* and 60*b* is shown. The female end rib 66 of panel 60*b* is placed over the supporting male end rib 68 of panel 60*a*. The shape and dimensions of the female end rib 66 and supporting male end rib 68 should be such that side wall 72 of female end rib 66 abuts against side wall 84 of supporting male end rib 68; side wall 80 of female end rib 66 abuts against side wall 84 of supporting male end rib 68; and top wall 66 of female end rib 66 abuts against top wall 88 of supporting male end rib 68. Note that tapered side wall 76 of female rib on panel 60*b* does not need to touch wall portion 102 of panel 60*a*, because it is supported by the top of the male rib and therefore is not purlin-bearing. At the same time, tapered side wall 84*b* on the male rib of panel 60*a* does extend down to and touch the purlin, because it is a purlin-bearing leg of the panel, which provides firm support to the lapping female-male rib combination.

Moreover, the lapped female-male ribs of the two panels force proper alignment of the two panels 60 with each other producing the panel assembly 64. The overlapped ribs along the panel lengths provide a ready means for preventing one panel from becoming cocked with respect to the other panel during installation. Because female end rib 66 covers supporting end rib 68, this rib assembly will provide the same visual appearance as interior upright ribs 90 formed on panels 60*a* and 60*b* to enhance the aesthetic appearance of the panel assembly 64. Moreover, the rib assembly will enhance the strength of the panel and provide means of attaching the panel at intermediate locations.

Rain water and moisture may tend to collect in the well formed by minor inverted rib 100 (see FIG. 3). This water may tend to get wicked up between female rib side wall 76 and male rib side wall 84*a*, since very tight clearances between the two side walls makes the water cling through capillary action. If left unconstrained, this water can travel upwards along the left side walls gap, through the gap between the rib top walls 70 and 88, and then downwards along the gap between the right sidewalls 72 and 84*b* of the lapped female and male ribs. However, the panel 60 of the present invention is designed with a void space 83 in the upper left corner between the lapped ribs to collect this migrating water and break the capillary action. A backup void 85 is formed in the upper right corner of the lapped ribs. These voids should be ⅛ inch wide or greater. The shortened leading side wall 76 of the female rib 66 will also serve to raise the gap entry point between the female and male ribs above inverted rib well 100, and therefore make it more difficult for the collected water to be drawn via capillary action into the gap between the rib walls.

The major ribs 90, 66 extending vertically from the substantially planar surface of panel 60 should preferably be about 1-2 inches wide across its base, more preferably about 1¼ inch, with a shorter width across the top wall due to the tapered side walls. Such top wall dimension is preferably about 1 inch wide. The major ribs 90, 66 should also preferably be about 1-2 inches tall, more preferably about 1¼ inch tall, or about 1½ inches tall with the batten cap installed. The side walls of the rib should be tapered, preferably with an about 10-30° slope. These sloped side walls make it easier to assemble the partial end rib 66 on top of the supporting end rib 68. The sloped side walls of the ribs also make it easier to stack panels on top of each other during transport, storage, or use at a construction site.

The panels 60 may be fabricated from sheet metal material such as galvanized steel that may optionally be pre-painted prior to manufacture. The galvanized coating may consist of zinc or aluminum/zinc, or zinc/manganese/aluminum mixtures. Alternatively, the panels may be fabricated from aluminum, which is lighter than galvanized steel and does not rust, but is also generally more expensive than galvanized steel. Copper is another material that may be used for the panels of the present invention, particularly for specialty applications. Any other type of metal or metal alloy may be used, provided that it can be roll formed to produce the necessary end profile for the panel. Alternatively, panels 60 may be fabricated from a plastic material, such as an acrylic resin with a fiberglass reinforcing material, or polycarbonate. While plastic may not hold the form for structural details as well as metal, it may still be suitable for panel applications that do not require such intricate details.

Figure 4:
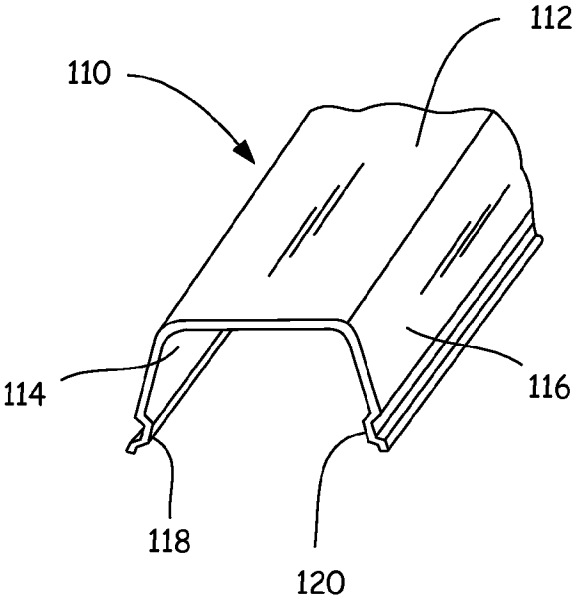
FIG. 4 is a perspective view of a batten cap cover of the present invention.

Batten cap 110 is shown in perspective view in FIG. 4. The cap is typically fabricated out of the same material as panel 60, although other alternative materials may be used. Batten cap 110 should be produced with the same length L as the length L of the panel 60 to which they will be secured.

The batten caps 110 are formed in substantially inverted U-shaped troughs with a flat, planar upper surface 112. However, upper surface 112 may alternatively be curvilinear or any other geometrical shape, if so desired. While the batten caps 110 are used to cover the ribs and the fasteners that penetrate the ribs to secure them to the roof purlins, as described below, they also provide an ornamental feature to the roof panel design.

The sides 114 and 116 extend downwardly from the upper surface 112 of batten cap 110. In a preferred embodiment, sides 114 and 116 are formed at an angle relative to the upper surface 112 in order to conform to and securely engage with the tapered side walls 76 and 72 of female end rib 66 which has been placed over supporting male end rib 68, as well as tapered side walls 92 of intermediate upright ribs 90.

The sides 114 and 116 of batten cap 110 include elongated folds or lips 118 and 180 formed along the interior surface of the side walls. While these elongated lips 118 and 180 are preferably located near the distal ends of the side walls 114 and 116, they can be formed along an interior position along the side walls, as long as the lips 118 and 180 can engage the detent grooves 80 and 96 in ribs 70 and 90, respectively, as discussed more fully below.

Figure 5:
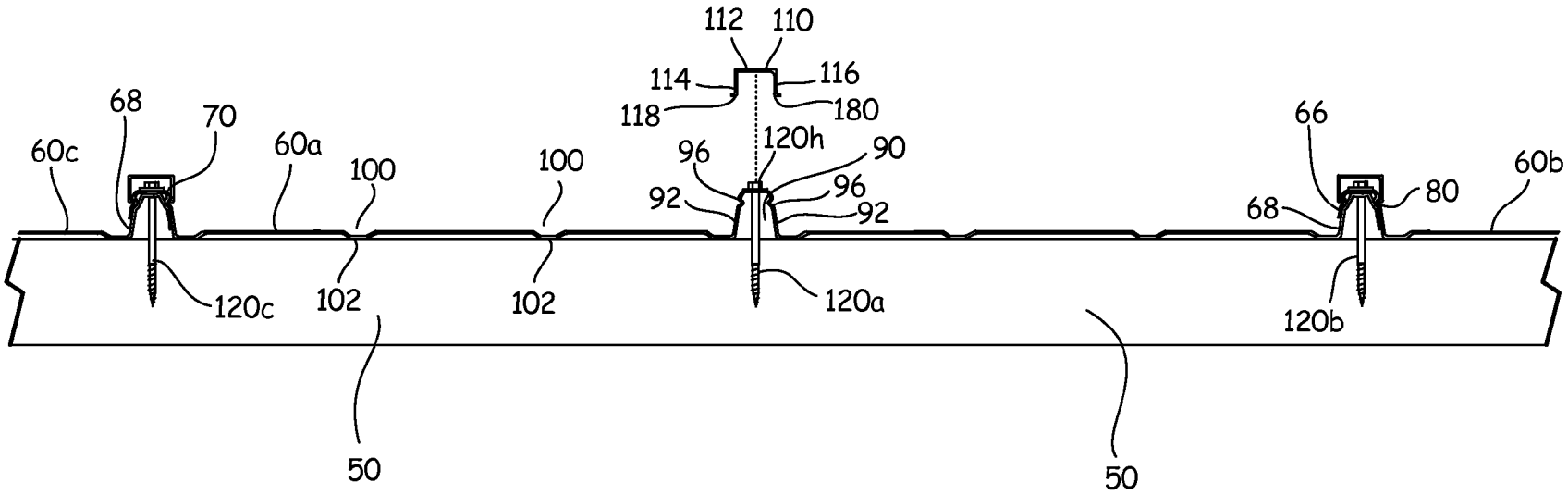
FIG. 5 is an edge view of a exterior cladding panel assembly secured to an underlying purlin with the batten cap covers secured to two of the raised ribs, and the batten cap cover removed from a third rib in exploded format.

Referring now to FIG. 5, an edge view of the three panels 60*a*, 60*b* and 60*c* assembled together and secured by means of fasteners 120(120*a*, 120*b*, 120*c*) to purlins 50 of the framing structure for the building's roof is shown. As shown more clearly in the drawing, panel 60 has female end rib 66, interior upright rib 90, and supporting male end rib 68 formed along its surface. Female end rib 66 of panel 60*b* fits over and around supporting male end rib 68 of panel 60*a*. Similarly, female end rib 66 of panel 60*a* fits over and around supporting male end rib 68 of panel 60*c*. Fastener 120*a* is driven through the top wall 94 of interior upright rib 90 and penetrates into the purlin 50 to secure the middle region of panel 60*a* to the purlin and its associated roof framing. Fastener 120*b* is driven through the top wall 74 of female end rib 66 of panel 60*b* and the top wall 88 of supporting male end rib 68 of panel 60*b* below it, and penetrates into purlin 50. This common fastener secures panels 60*b* and 60*a* in their interconnected state to the purlin and its associated roof framing. Meanwhile, fastener 120*c* is driven through the top wall 74 of female end rib 66 of panel 60*a* and top wall 88 of supporting male end rib 68 of panel 60*c* below it, and likewise penetrates into purlin 50. This common fastener 120*c* secures panels 60*a* and 60*c* in their interconnected state to the purlin and its associated roof framing. Longitudinal creases 75 and 99 may be formed within the top walls 74 and 98 of the female rib 66 and interior rib 90, respectively, to assist a construction worker to properly position the fasteners 120(120*a*, 120*b*, 120*c*) to drive them through the rib top walls into the purlins below.

In order to prevent rain and other moisture from penetrating through the region of panel 60*a* pierced by fastener 120*a*, batten cap 110 is placed over the top of intermediate upright rib 90 with its elongated lips 118 and 180 snapped into engagement with longitudinal detent grooves 96 formed into side wall 92 of the rib. This batten cap 110 completely covers fastener heads 120*h*. At the same time, the batten cap 110 will also conceal the fastener heads to improve the aesthetic appearance of the panel 60*a* when it is secured to the roof. Similar batten caps 110 cover and conceal the respective fasteners 120*b* driven into the interconnected panel 60*b* female end rib 66/panel 60*a* supporting male end rib 68, and fasteners 120*c* driven into the interconnected panel 60*a* female end rib 66/panel 60*c* supporting male end rib 68. With these batten caps 110, the major ribs formed along the panel assembly 64 will appear identical for aesthetic purposes.

Fasteners 120(120*a*, 120*b*, 120*c*) may constitute nails or screws. Screws are preferred because their helical flights impede the loosening of the screws from the purlins 50 when a force, such as a strong wind, is applied to the panels 60 on the roof top. However, nails with rings along their shank will bite into the wood material of the purlin, therefore holding the panels securely to the purlins. The fasteners 120(120*a*, 120*b*, 120*c*) should be fabricated from a suitable material that is strong and rust-resistant. Galvanized steel and stainless steel are two appropriate materials, although other materials are available. A suitable sealant or grommet ring may be placed on each screw or nail head before placement of the batten cap 110 to enhance water leakage resistance.

Figure 6:
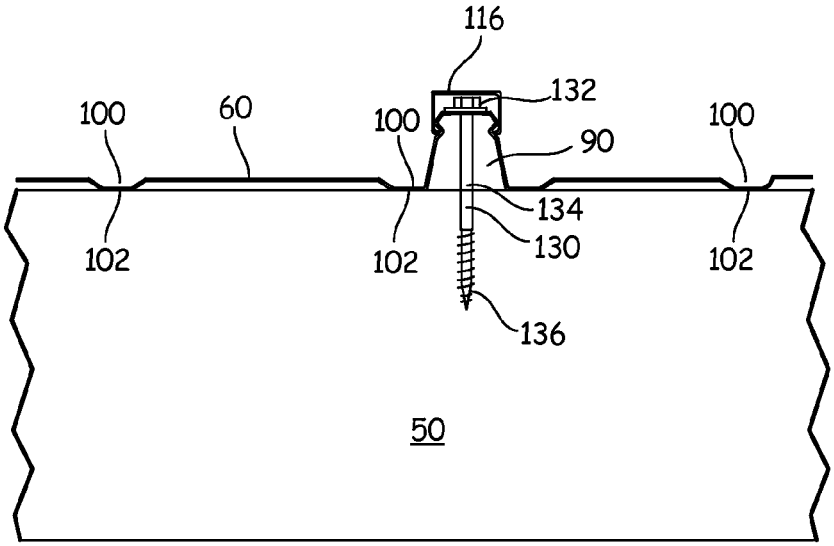
FIG. 6 is a cut-away view of the exterior cladding panel secured to the underlying purlin by an extended-shank screw, and with the batten cap cover secured to the raised rib.

A preferred embodiment of fastener 130 is shown in FIG. 6. It constitutes an elongated-shank screw having a head 132, shank 134, and helical flight threaded portion 136. For a #12 or #14 screw that is 2½ or 3 inches in length, the threaded portion of the screw should cover at least approximately 1 inch from the tip end of the screw to provide sufficient bite in the wood purlin 50 to inhibit disengagement of the screw from the purlin under, e.g., windy conditions. At the same time, shank portion 134 of the screw 130 should be sufficiently long, so that at least ¼ inch of the shank extends below the purlin surface when the screw is driven into the purlin to secure the panel 60 in place. Because the diameter of the shank region 134 is greater than the diameter of the threaded region 132 and does not contain reduced material around the screw flights, this extended-shank screw 130 will be less likely to break off along the top surface of the purlin 50 under, e.g., wind shear. The use of these extended-shank screws 130 will help to secure the panels 60 to the roof under windy conditions.

Figure 7:
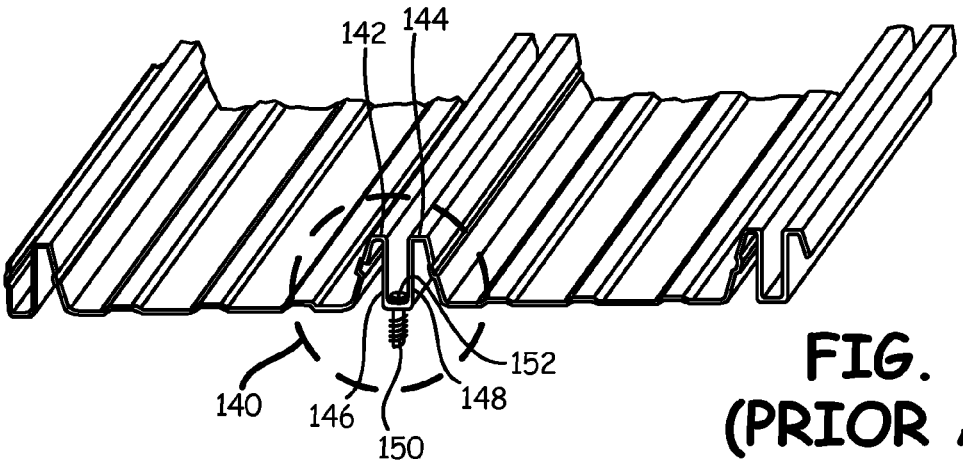
FIG. 7 (PRIOR ART)
FIG. 7 is a perspective view of a portion of a prior art panel product secured to an underlying framing member.

Unlike panel assemblies of the prior art, the exterior cladding panel assembly 64 of the present invention provides several advantages. First, interior upright rib 90 and female end rib 66 contain an inverted-U end profile characterized in general by two side walls and a top wall. This is different from the W-shaped end profile configuration of the upright rib structure of, e.g., U.S. Pat. No. 7,104,020 shown in FIG. 7 where the "rib" 140 actually consists of a left-hand rib 142 and right-hand rib 144 in combination. Such a prior art structure requires additional material along the left-hand rib inner side wall 146 and right-hand rib inner side wall 148, as well as additional folding of the material during the manufacturing operation to produce such a double-ribbed, W-shaped end profile. The inverted U-shaped profile of the exterior cladding panel 60 of the present invention improves the economics of panel manufacture by more than fifteen percent reduced materials costs and significantly reduced capital equipment, packaging, and transport costs. Thus, the panel design of the present invention provides the full package of physical features and economies required for a commercially viable product.

Second, unlike the W-shaped end profile of the prior art roofing panel in which the screw 150 is driven into a trough portion 152 of the rib profile directly against the roof framing member, the fastener 130 for the exterior cladding panel system of the present invention is driven into the tops of the ribs 90, 68 which do not directly abut against the purlin 50 or other roof framing member. Instead an open space exists between the rib top of the U-shaped end profile and the purlin. It is easier for a construction worker to drive a fastener 130 into the top surfaces of the upright ribs, instead of down into the trough 152 between left-hand rib 142 and right-hand rib 144 as is required for the prior art system (See FIG. 7). At the same time, Applicants have discovered to their surprise that this U-shaped rib end profile where the panel 60 does not directly abut against the purlin at the point of screw connection still provides superior attachment of the panels to the purlins even under windy conditions that can produce forces that could otherwise lift the panels vertically off the roof framing members, or shift them laterally or longitudinally along the roof line. At the same time, there is no need under the exterior cladding panel system of the present invention to use wood fill cleating strips prepositioned on the purlins to fill up the open space inside the U-shaped rib with solid backing material, and to provide an abutment surface against which the top surface of the U-shaped rib can be directly secured. Dispensing with these cleating strips saves significant time and materials costs during the installation of the roofing panels to the roof.

Figure 8:
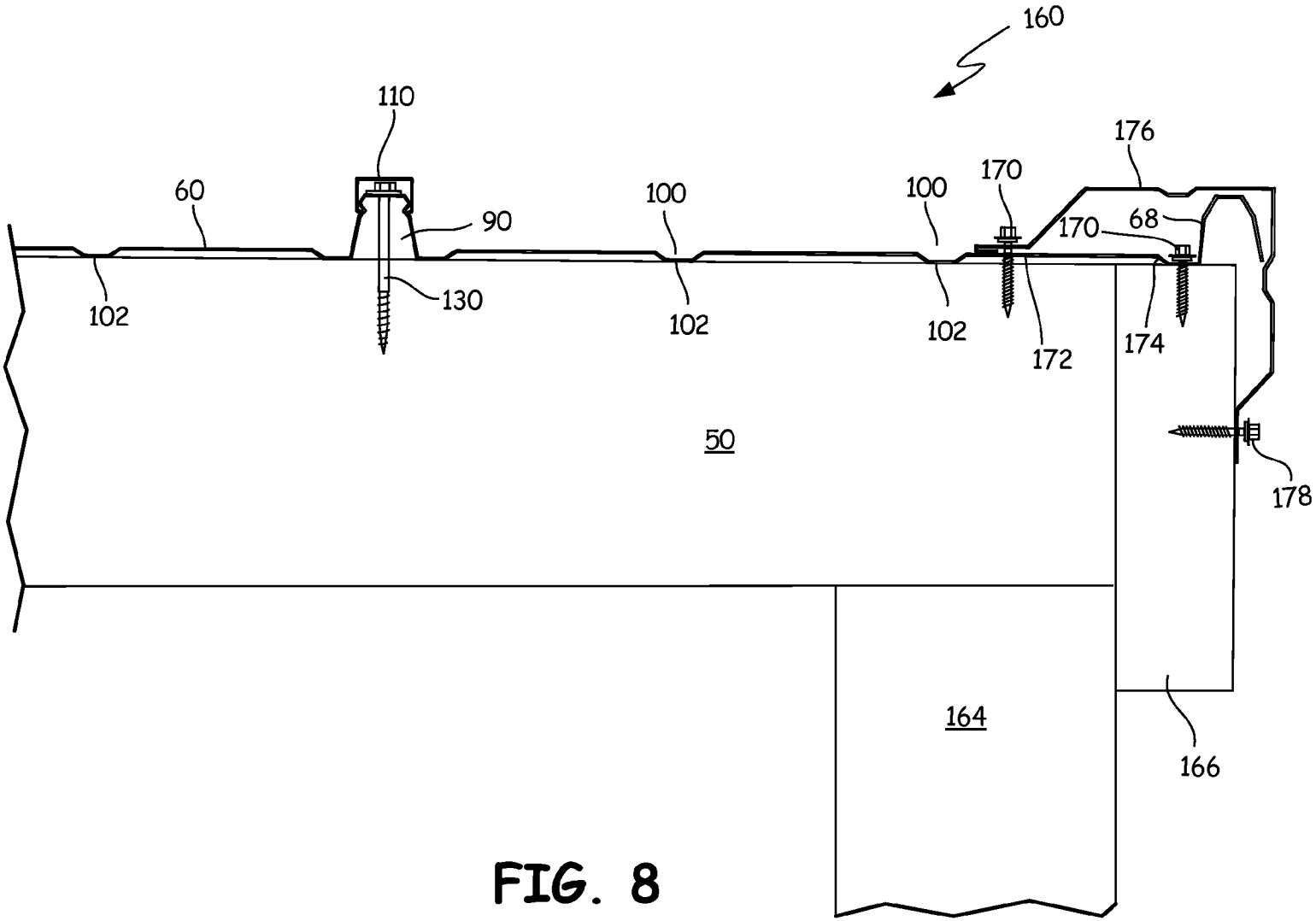
FIG. 8 is an end view of an exterior cladding panel of the present invention secured to the edge of a building roof line with extra securement means for preventing panel migration along the purlins, and with a gable flashing secured to the panel's edge.

FIG. 8 shows a preferred embodiment of the exterior cladding panel system of the present invention with a focus upon the lateral edge of the roofing panel assembly 64. Purlin 50 is attached to truss 42, which in turn rests on top of wall stud or header plate 164. Facia board 166 is secured to the lateral end of the purlin/truss assembly to define the lateral edge of the roof line. Exterior cladding panel 60 is positioned against the top of the surfaces of purlin 50, truss 42, and facia board 166 so that supporting male end rib 68 hangs slightly beyond the facia board 166. Extended-shank screws 130 penetrate the top wall 94 of interior upright rib 90 to secure it in place along the purlins 50 with the open space between the rib top and purlin, as described above. Meanwhile fasteners like screws 170 are driven through the flat regions 172 of panel 60 and the inverted rib 174 to secure the panel in direct abutted relationship against the purlin 50 and facia board 166. Gable flashing 176 may then be used to cover the edge of panel 60, including supporting end rib 68 and secured to the room in direct abutted relationship by means of screws 170 and 178. Not only does gable flashing 176 act to prevent wind shear from lifting up the lateral edge of panel 60 from the roof line, but also it provides an aesthetically pleasing decorative covering around the edge of the roofing panel assembling. Moreover, screws 170 will prevent lateral movement of panel 60 along the roof top under the influence of the wind.

Figure 2:
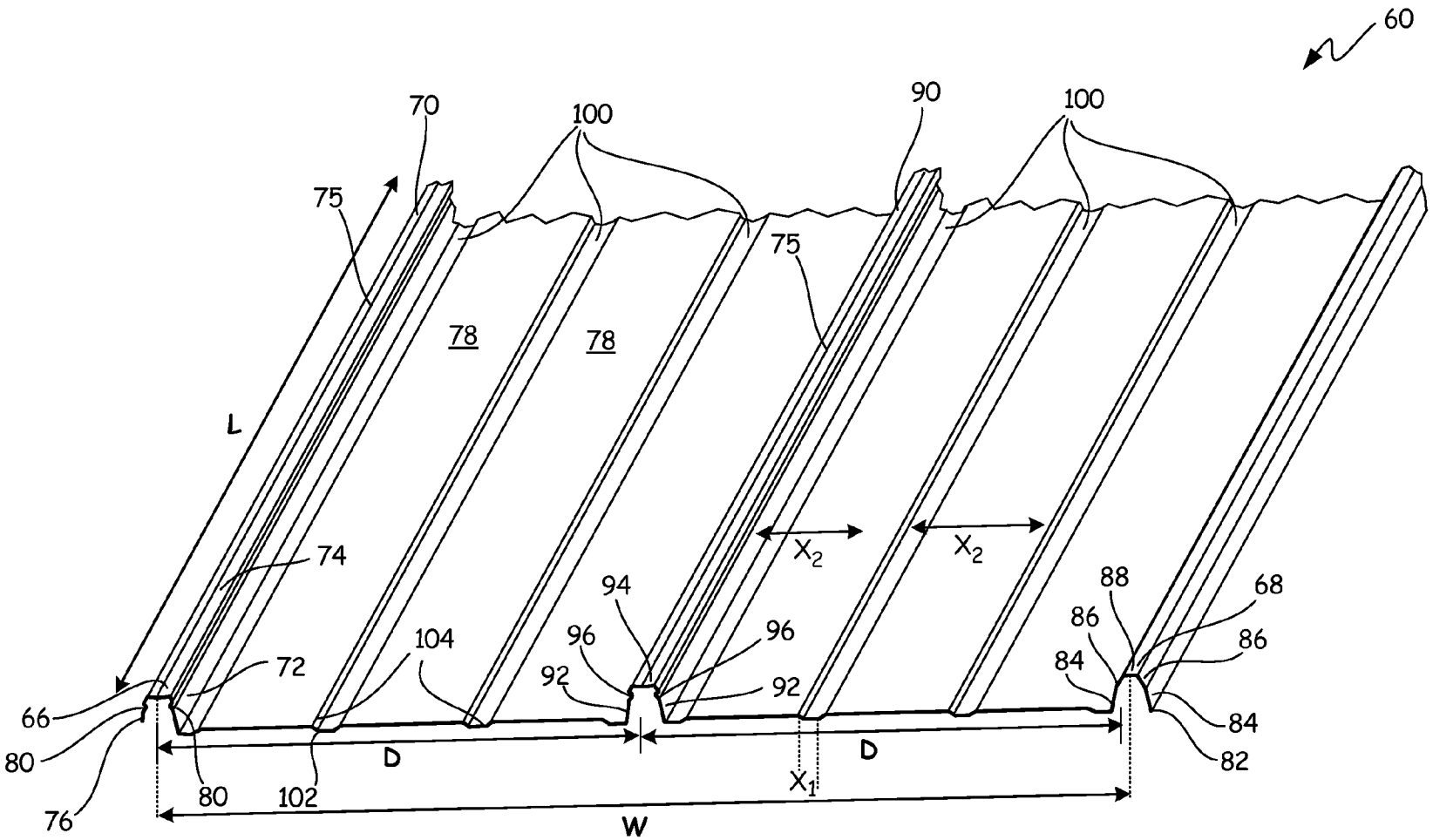
FIG. 2 is a perspective view of a portion of the exterior cladding panel of the present invention.

In an important feature of the exterior cladding panel system of the present invention, panels 60 include a plurality of inverted "minor" ribs 100 (see FIG. 2). These minor ribs are positioned along the flat region of the panel between the upright major ribs 90, 68. The minor ribs 100 run parallel to the major upright ribs. They feature a substantially flat bottom surface 102 with tapered side walls 104. Thus, the flat bottom surfaces 102 rest upon the purlins 50, and enable the broader flat regions 78 of the panel to be elevated a small distance above the purlins. If the flat panel regions 78 rested directly on top of the purlins, then the panel 60 would tend to hump up and hump down over the purlin over time due to changing temperatures and building movements to impart stresses on the panel's flat panel regions. This natural process called "oil canning" would add unwanted undulations to the panel 60 which would ruin the decorative appearance of the roof panel. The inverted minor ribs 100 act to stiffen the panel to minimize these puckered undulations, and to break up the stress fields to make any puckering less noticeable. The slight elevation of the panel's flat pan regions 78 above the purlins 50 also acts to reduce any formation of the purlin's profile into the panel over time ("ghosting"). Because the width of the bottom surface 102 of the minor inverted ribs 100 is substantially less than the width of the flat panel regions 78, most of the panel 60 will lie spaced above the purlins. These minor inverted ribs 100 should preferably be about ¼ to 1 inch wide, preferably ½ inches wide across the flat bottom 102. The minor inverted ribs 100 should also preferably be about ⅛ to 3/16 inches tall, measured between their flat bottom and flat planar region 78 of the panel 60.

The exterior cladding panels 60 of the present invention should be fabricated from light-weight 29 to 22 gauge (i.e., 0.015 to 0.03 inches) thickness metal coil. The metal material is roll formed at the point of manufacture, whereby the coil of flat metal is uncoiled and passed through a series of interlocking rolls which progressively bend the material to produce the interior upright ribs 90, female end rib 66, supporting male end rib 68, minor inverted ribs 100, and other structural features of the final shape of the panel. This roll forming process for light-gauge metal material is well-known in the art. If plastic material is used instead for the panels, then an extrusion or mold casting process should be used in order to provide the necessary structural features for the ribs.

The above specification and drawings provide a complete description of the exterior cladding panel system 10 of the present invention. Since many embodiments of the invention can be made without departing from the spirit and scope of the invention, the invention resides in the claims hereinafter appended.

I claim:

1. A method of securing two or more panels to substantially parallel, spaced framing members of a building, each panel comprising:

(a) a sheet of material having a top surface, a first lateral edge and a second lateral edge opposite the first lateral edge;

(b) at least one interior rib formed in and extending upwardly from the top surface of the sheet of material, the interior rib having a generally inverted U-shape including a top wall for receiving a fastener to secure the interior rib to a building framing member, a first side wall and a second side wall opposite the first wall, the interior rib being positioned at a point along the panel between the first lateral edge and the second lateral edge of the panel, the interior rib further having a first longitudinal detent formed along the first side wall and a second longitudinal detent formed along the second side to define a head, neck and body region of the interior rib;

(c) a female rib formed in and extending upwardly from the top surface of the sheet of material along the first lateral edge of the panel, the female rib having a generally inverted U-shape including a top wall, a first side wall and a second side wall opposite the first wall, a first longitudinal detent formed along the first side wall of the female rib and a second longitudinal detent formed along the second side wall of the female rib to define a head, neck and body section of the female rib;

(d) a male rib formed in and extending upwardly from the top surface of the sheet of material along the second lateral edge of the panel, the male rib having a generally inverted U-shape including a top wall, a first side wall and a second side wall opposite the first wall and an end profile slightly smaller than an end profile of the female rib, such that the female rib of a first panel will nest on top of the male rib of a second underlying panel so the male and female top walls are aligned for fasteners to pierce the top walls of the nested female and male ribs into a building framing member;

(e) a generally inverted U-shape batten sealing cap adapted to cover the head region of the interior and female ribs, the batten sealing cap having a top wall and two side walls with outer edges, the batten sealing cap being secured to the interior or female rib by engagement of the side wall edges with corresponding first and second longitudinal detents forming the neck of the interior or female rib, such that the top wall of the batten sealing cap is spaced from the top wall of the interior or female rib to accommodate a space required for the head of the fasteners, the method comprising the steps of:

a. placing a first panel on framing members oriented perpendicular to the ribs of the first panel, aligning the female rib with an edge of the building area to be covered;

b. fastening the panel to the framing by driving fasteners through the female and interior ribs into each underlying framing member;

c. installing batten sealing caps onto the top of the female and interior ribs of the first panel;

d. placing a second panel in adjoining relation with the first panel with the female rib of the second panel placed over the male rib of the first panel;

e. installing fasteners through the female and interior ribs of the second panel into each underlying framing member; and f. installing batten sealing caps onto the top of the female and interior ribs of the second panel.

2. A cladding panel assembly for attachment to a framing member of a building, the panel comprising:

(a) a sheet of material having a top surface, a first lateral edge and a second lateral edge opposite the first lateral edge;

(b) at least one interior rib formed in and extending upwardly from the top surface of the sheet of material, the interior rib having a generally inverted U-shape including a top wall for receiving a fastener to secure the interior rib to a building framing member, a first side wall and a second side wall opposite the first wall, the interior rib being positioned at a point along the panel between the first lateral edge and the second lateral edge of the panel, the interior rib further having a first longitudinal detent formed along the first side wall and a second longitudinal detent formed along the second side wall to define a head, neck and body region of the interior rib;

(c) a female rib formed in and extending upwardly from the top surface of the sheet of material along the first lateral edge of the panel, the female rib having a generally inverted U-shape including a top wall, a first side wall and a second side wall opposite the first wall, a first longitudinal detent formed along a first side wall of the female rib and a second longitudinal detent formed along an opposite second side of the female rib to define a head, neck and body section of the female rib;

(d) a male rib formed in and extending upwardly from the top surface of the sheet of material along the second lateral edge of the panel, the male rib having a generally inverted U-shape including a top wall, a first side wall and a second side wall opposite the first wall and an end profile slightly smaller than an end profile of the female rib, such that the female rib of a first panel will nest on top of the male rib of a second underlying panel so the male and female top walls are aligned for fasteners to pierce the top walls of the nested female and male ribs and their corresponding underlying building framing member;

(e) a generally inverted U-shape first batten sealing cap adapted to cover the head region of the interior rib, the first batten sealing cap having a top wall and two side walls with outer edges, the first batten sealing cap being secured to the interior rib by engagement of the side wall edges with corresponding first and second longitudinal detents forming the neck of the interior rib, such that the top wall of the first batten sealing cap is spaced from the top wall of the interior rib to accommodate the space required for the head of the fasteners; and (f) a generally inverted U-shape second batten sealing cap adapted to cover the head region of the female rib, the second batten sealing cap having a top wall and two side walls with outer edges, the second batten sealing cap being secured to the female rib by engagement of the side wall edges with corresponding first and second longitudinal detents in the female rib, such that the top wall of the second batten sealing cap is spaced from the top wall of the female rib to accommodate the space required for the head of the fasteners.

3. The panel assembly of claim 2, wherein a second identical panel assembly is positioned adjacent to the first panel assembly with the supporting male rib of the second panel disposed inside the female rib of the first panel in a lapped configuration.

4. The panel assembly of claim 3, further comprising a fastener having a head end and an attachment end that pierces the lapped female and supporting male ribs with the attachment end engaging the framing member of the building to secure the panel assembly to the building, the head end being disposed between the female rib and the respective sealing batten cap to conceal it.

5. The panel assembly of claim 4, wherein there is no solid filler material disposed on the framing member of the building between an interior surface of the supporting male rib and the framing member.

6. The panel assembly of claim 3, wherein the lapped female and supporting male ribs forces proper alignment of the two panels with respect to each other.

7. The panel assembly of claim 4, wherein the fastener comprises an extended shank portion between the head end and attachment end so that the shank portion extends into the framing member thereby improving the strength and toughness of the fastener by eliminating stress risers associated with deformation of the fastener shank.

8. The panel assembly of claim 3 further comprising a void formed between the walls of the lapped female rib and male rib to break capillary action that draws migrating water between the rib walls.

9. The panel assembly of claim 2, wherein no separate clips are used to secure the panel assembly to the framing member of the building.

10. The panel assembly of claim 2 further comprising at least one minor rib having a pair of side walls and a bottom wall formed in the sheet of material extending downwardly from the surface of the sheet between two substantially flat pan regions formed in the sheet, such that when the panel is mounted to building framing members, the bottom wall of the minor rib will be disposed against the building framing members to space a greater portion of the pan regions of the panel away from the framing members to minimize the formation of the shape of the framing member within the pan regions of the panel.

11. The panel assembly of claim 2 further comprising at least one minor rib having a pair of side walls and a bottom wall formed in the sheet of material extending downwardly from the surface of the sheet between two substantially flat pan regions formed in the sheet to stiffen the flat pan regions of the panel to minimize undulations formed in the panel.

12. The panel assembly of claim 2, wherein at least one side wall of the interior rib is tapered with respect to the surface of the sheet adjacent to the interior rib.

13. The panel assembly of claim 12, wherein the tapered side wall of the interior rib enables nesting of two panels one on top of the other.

14. The panel assembly of claim 2, wherein at least one side wall of the female rib is tapered with respect to the surface of the sheet adjacent to the interior rib.

15. The panel assembly of claim 14, wherein the tapered side wall of the female rib enables nesting of two panels one on top of the other.

16. The panel assembly of claim 2, wherein the interior rib and female rib with the sealing batten caps engaged thereto appear substantially identical.

17. The panel assembly of claim 2, wherein when the panel assembly is installed to the building, it provides substantially waterproof protection to the building.

18. The panel assembly of claim 2, wherein the interior rib enhances the strength and stiffness of the panel to allow the panel to span multiple framing members on the building without structural sheathing disposed between the panel and framing members.

19. The panel assembly of claim 2 further comprising a longitudinal crease formed within the top wall of the female rib or interior rib to assist in the proper orientation of a fastener driven through the rib top wall into the building framing member below.

* * * * *